US009656726B2

(12) United States Patent
Cassanas et al.

(10) Patent No.: US 9,656,726 B2
(45) Date of Patent: May 23, 2017

(54) INFLATABLE CRAFT HAVING V-SHAPED HULL AND FLAPS

(71) Applicant: ZODIAC MILPRO INTERNATIONAL, Paris (FR)

(72) Inventors: Marc Cassanas, Figueres (ES); Lionel Boudeau, Meudon (FR)

(73) Assignee: ZODIAC MILPRO INTERNATIONAL, Paris (FR)

( * ) Notice: Subject to any disclaimer, the term of this patent is extended or adjusted under 35 U.S.C. 154(b) by 0 days.

(21) Appl. No.: 14/910,388

(22) PCT Filed: Aug. 6, 2013

(86) PCT No.: PCT/FR2013/051896
§ 371 (c)(1),
(2) Date: Feb. 5, 2016

(87) PCT Pub. No.: WO2015/018984
PCT Pub. Date: Feb. 12, 2015

(65) Prior Publication Data

US 2016/0185424 A1 Jun. 30, 2016

(51) Int. Cl.
*B63B 1/00* (2006.01)
*B63B 7/08* (2006.01)
(Continued)

(52) U.S. Cl.
CPC ..... *B63B 7/082* (2013.01); *B63B 1/042* (2013.01); *B63B 41/00* (2013.01); *B63B 2041/003* (2013.01)

(58) Field of Classification Search
CPC .. B63B 7/00; B63B 7/08; B63B 7/082; B63B 1/042; B63B 41/00; B63B 2041/003; B63B 2007/00; B63B 2007/06
(Continued)

(56) References Cited

U.S. PATENT DOCUMENTS 4,603,651 A * 8/1986 Harding ..... B63B 7/082 114/345
4,640,217 A 2/1987 Ferronniere
(Continued)

FOREIGN PATENT DOCUMENTS

FR 2510064 1/1983
FR 2778626 11/1999

OTHER PUBLICATIONS

International Search Report, dated May 14, 2014; Application No. PCT/FR2013/051896.

*Primary Examiner* — Daniel V Venne
(74) *Attorney, Agent, or Firm* — Young & Thompson

(57) ABSTRACT

Disclosed is a vessel with two watertight flaps attached in a tensioned state on the two sides of the longitudinal keel, each being under one of the two rear side portions of the V-shaped hull, the outer side edge of each flap being connected under the shell covering the bottom compartment on the same side, and the bottom side edge being connected to the bottom along a line which is angled from the rear to the front and angled toward the lower compartment, with a flap width tapering from the tensioned, free rear edge between the ends at the transom, toward a front portion connected to the bottom and/or to the shell at the connection between the upper and lower compartments, defining, with the latter and the bottom, a channel converging from front to rear and angled toward the rear end of the edge of the V-shaped craft hull.

18 Claims, 4 Drawing Sheets

(51) Int. Cl.
*B63B 1/04* (2006.01)
*B63B 41/00* (2006.01)

(58) Field of Classification Search
USPC ..... 114/61.1, 61.25, 61.32, 61.33, 345
See application file for complete search history.

(56) References Cited

U.S. PATENT DOCUMENTS

| | | | | |
|---|---|---|---|---|
| 5,642,685 | A * | 7/1997 | Garnier | B63B 7/082 114/345 |
| 5,868,095 | A * | 2/1999 | Zeromski | B63B 7/085 114/345 |
| 6,192,822 | B1 | 2/2001 | Lavorata et al. | |
| 7,775,172 | B2 * | 8/2010 | Hansen | B63B 1/16 114/123 |
| 7,987,806 | B2 * | 8/2011 | Chang | B63B 3/38 114/345 |
| 8,800,466 | B1 * | 8/2014 | Shimozono | B63B 1/22 114/345 |
| 9,114,853 | B1 * | 8/2015 | Apple | B63B 7/082 |

* cited by examiner

INFLATABLE CRAFT HAVING V-SHAPED HULL AND FLAPS

BACKGROUND OF THE INVENTION

The present invention relates to improvements made to inflatable craft of the type comprising at least one inflatable sponson forming two substantially parallel members meeting towards the front to form a bow, and a transom linking said members and capable of receiving at least one motor or engine, each of said members comprising, at least in the substantially parallel portion thereof, several tubular compartments, each having a substantially circular cross-section, one of which is an upper compartment and one a lower compartment, placed longitudinally next to one another along a lower, circumferential area, facing the other member, of said upper compartment, which has a cross-section greater than that of said lower compartment, held against said upper compartment by a flexible side shell, made from cloth or fabric, which at least partially surrounds it and is firmly fixed to said upper compartment, said flexible shell being secured tangentially to said upper and lower compartments on the outer side of the member in question. In addition, a longitudinal keel is placed between a structural element forming a floor, which may be for example rigid, flexible or foldable, in the upper portion, which is held, at least in a transverse direction, along said two members, and a structural element forming a waterproof bottom, such as for example a waterproof bottom fabric, in the lower portion, which is connected to the peripheral edges of said floor, said keel tensioning said bottom, giving it the form of a V-shaped hull.

DESCRIPTION OF THE RELATED ART

Craft of this type are known, in particular from FR 2 778 626 and FR 2 510 064, and are satisfactory due to their improved seaworthiness characteristics at high speeds, in particular as regards comfort, ease of getting on the plane and maintaining their heading, while at low and medium speeds keeping the propeller of the outboard motor mounted on their transom properly immersed, and craft of this type are experiencing significant growth.

By "getting on the plane" is meant the change of type of forward movement of an object in water from an "Archimedean" type (the object floats due to Archimedean buoyant force) to a dynamic type in which its speed allows it to be borne by the surface of the water.

However, when a craft of this type is heavily laden, it is found that its maximum speed may be severely limited, and that the craft may even have difficulty in getting on the plane.

SUMMARY OF THE INVENTION

It therefore seemed desirable to modify the structure of craft of this type, without however making their manufacture and maintenance much more complex and expensive, while still allowing them to reach a higher maximum speed and have the ability to get on the plane with heavier loads without a corresponding increase in the engine power.

To this end, the inflatable craft of the type presented above, and according to the invention, is characterized in that two watertight flaps, made from waterproof cloth or fabric, are attached in a tensioned state, substantially symmetrically on either side of said longitudinal keel, each under respectively one of the two rear side portions of said hull, each flap having an outer side edge along which said flap is connected to the lower portion of the lower compartment of the corresponding side or of said shell that covers it, and an inner side edge along which said flap is connected to the bottom, along a line extending from the rear to the front of the flap and of the craft, while being angled towards said lower compartment, the width of said flap tapering gradually from the tensioned, free rear edge thereof between the ends thereof, substantially at said transom, towards a front portion of the flap that is connected to the bottom and/or to said lower compartment or to said corresponding shell, at the connection between the upper and lower compartments, each flap thus defining, with said lower compartment and the bottom, a channel converging from the front to the rear and angled towards the rear end of the ridge of the V-shaped hull, and capable of guiding and accelerating a flow of water towards the area situated under the central portion of the transom.

Moreover, and simultaneously, as soon as the craft moves forwards, the flaps provide a lift that has the effect of raising the rear of the craft, under the action of water that is displaced relative to the V-shaped hull. The tunnel effect provided by the converging channels defined by the two flaps with the V-shaped hull has the effect of concentrating, channeling and accelerating the flow of water with respect to the hull, the water being guided to the area situated under the central portion of the transom, where the propeller is located, where the water arrives at higher speed, and allows the motor or engine and therefore the propeller to rotate more quickly, in particular in the phase of getting on the plane, during which the motor or engine usually struggles to increase its speed if the boat is heavily laden, which has the effect of improving the acceleration and therefore facilitating getting on the plane.

In an advantageous embodiment of a craft according to the invention, each flap has a substantially trapezoid general shape, in which the long base and the short base respectively constitute the rear edge and a front edge of the flap, and the sides of which constitute the outer and inner side edges of the flap.

This advantageous embodiment is also, preferably, such that the rear edge of each flap extends transversally from an inner end situated substantially on the ridge of said V-shaped hull, in the middle of the base of the transom.

However, according to a variant of the craft of the invention, the rear edge of each flap extends transversally from an inner end situated within the half, adjacent to the ridge of said V-shaped hull, of the portion of the bottom constituting the adjacent side of the V-shaped hull.

Preferably, in the different embodiments according to the invention, the craft is such that the flaps extend forwards from said transom, over a length, parallel to said longitudinal keel, comprised between approximately 55% and approximately 75% of the length of the craft.

In a preferred embodiment, the flaps extend substantially over the rear two-thirds of the craft.

The flaps can be two pieces of cloth or fabric, for example impregnated and waterproof, separate from one another, and for example impregnated with a substance such as polyurethane.

However, in order to make the manufacture of the craft easier and more cost-effective, the flaps can each be formed by respectively one of two portions of a single piece of cloth or fabric. In this case the two portions are symmetrical to one another, on either side of a joining strip between these two portions. Another possibility for cost-effective production is for each flap to be made from a single piece of cloth or fabric with said shell associated with said lower compartment of the corresponding side, or for a single piece of cloth or fabric to make it possible to constitute the two flaps and the two shells of the lower compartments at the same time.

Moreover, in a preferred embodiment, a deflector, capable of deflecting water downwards, is mounted transversally projecting under each of said two members, behind the rear edge of said flaps. This deflector also has the effect of generating lift, which tends to raise the rear of the craft when it moves forwards.

In a cost-effective embodiment, said deflector is a profile made from synthetic material having a triangular cross-section, which is attached onto the upper compartment and said shell, substantially along the lower half of the periphery of said member.

In a known manner, each member ends in a dome or cone with a point directed towards the rear, and according to the invention, said deflector is advantageously secured substantially at the base of the dome or of said cone.

Also in a known manner, the keel is advantageously an inflatable keel constituted by at least one elongated inflatable enclosure.

Also as known, the floor can be held pressing against the lower inner face of said upper compartments, and the bottom is secured to said members, at the connections between said upper and lower compartments. Similarly, said upper and lower compartments of each sponson member can comprise two inflatable compartments, and respectively constitute a main float and an auxiliary float. Each auxiliary float can comprise at least one inflatable elongated body, the cross-section of which increases gradually, then decreases, from the front to the rear.

Finally, also in a known manner, each shell advantageously has a closed, profiled forward end with an upwardly-angled lower portion.

By means of these known arrangements, combined with the arrangements presented thereabove and specific to the invention, the manufacture of craft according to the invention is simplified. The main floats of the two members are all identical, as are the auxiliary floats, whereas the manufacture of these is the most demanding, when they are provided in inflatable form, due to fact that they must be watertight. In a craft according to the invention, only the shells, which can be produced in a non-watertight manner when they are not made from a single piece of cloth or fabric with the flaps, and only the flaps, need be differentiated for the right and left sides, but this differentiation is obviated when the two flaps, like the two shells, are constituted by a single piece of suitable cloth or fabric. Moreover, when the auxiliary floats are detachable, as known from FR 2 778 626, the teachings of which are compatible with the present invention, and to which reference may be made for further details in this regard, all the advantages specific to inflatable and detachable auxiliary floats are retained by a craft according to the present invention.

Generally, the improved arrangement introduced by the invention in inflatable craft of the type discussed in the introduction is found to be advantageous in respect of getting on the plane and the maximum speed that can be reached under load, for a given installed engine power, while being cost-effective both for manufacture and for maintenance.

BRIEF DESCRIPTION OF THE DRAWINGS

The invention will be better understood on reading the following detailed description of certain preferred embodiments, given by way of non-limitative example only.

In this description, reference is made to the attached drawings, in which.

DETAILED DESCRIPTION OF THE PREFERRED EMBODIMENTS

Figure 4:
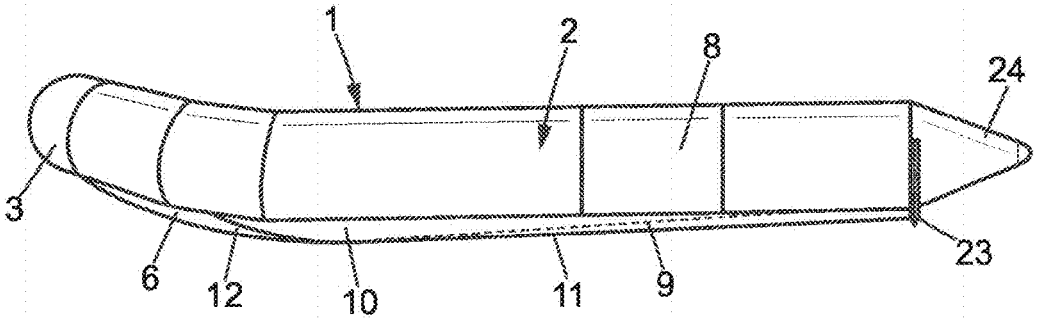
FIG. 4 is a diagrammatic side view of the inflatable craft in FIGS. 1 and 2.
Figure 5:
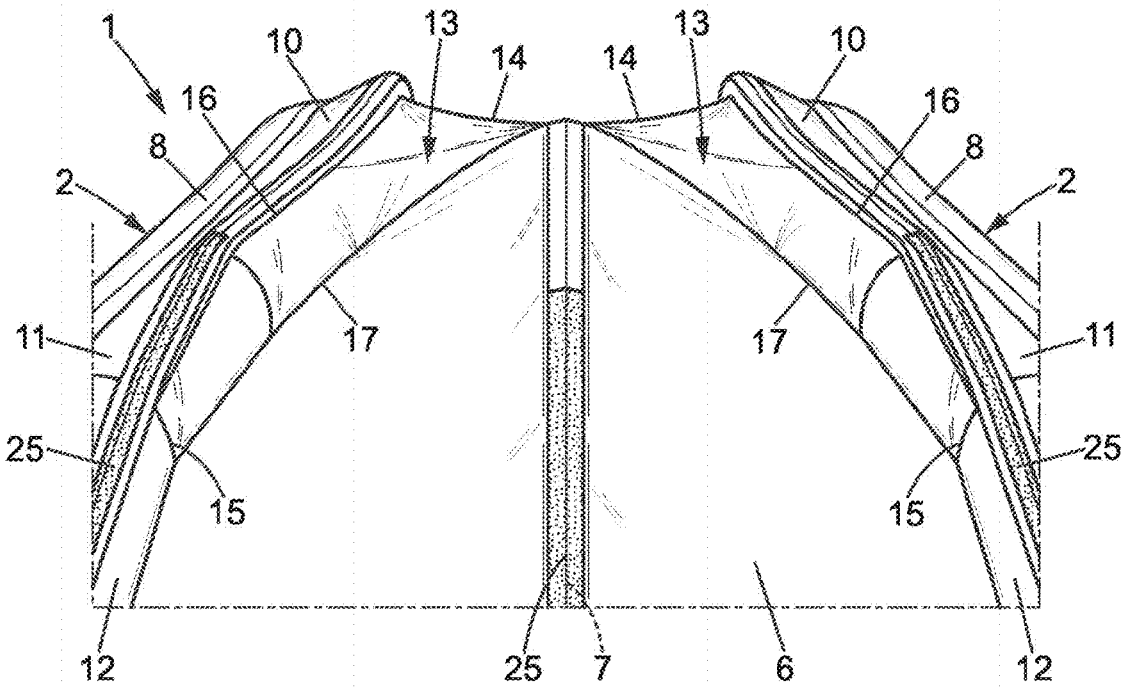
FIG. 5 is a partial top perspective view from front to rear of the inflatable craft in FIGS. 1, 2 and 3, inverted and showing its hull upwards.

Referring firstly to FIGS. 1, 2 and 4 to 6, a craft according to the invention comprises an inflatable sponson 1 forming two opposing elongate members, comprised of two substantially parallel rearward portions (two substantially parallel members 2) being substantially parallel to each other and frontward portions that converge and meet towards the front to form a bow 3 (not shown in FIG. 5).

A transom 4 (shown in FIGS. 2 and 6) links the two members 2 of the sponson 1 close to their rear ends, and is intended to close the rear of the craft in a watertight manner and to support at least one motor or engine, in particular of the outboard type (not shown).

Along the two members 2 of the sponson 1 of the craft a floor 5 (see FIG. 3*a*) is held in place, internally and at least transversally, which can be rigid, flexible or foldable, and made in any suitable known manner (slats or panels made of wood or metal or a synthetic material, inflatable bottom, for example).

A watertight bottom, constituted for example by a waterproof bottom fabric 6, situated under the floor 5, is connected to the sponson 1 along the connection between the members 2 thereof and the floor 5. A longitudinal keel 7 is placed between a first structural element (forming the floor 5 of the inflatable craft) and a second structural element (forming the watertight bottom fabric 6; see (FIG. 3*a*) which tensions the fabric 6 in order to give it the form of a V-shaped hull. The keel 7 can be of any suitable type; for example it is preferably an inflatable keel constituted by at least one elongated inflatable volume.

Each member 2 of the sponson 1 is constituted by several elongated inflatable compartments (in the form of sponsons having a substantially circular cross-section), superimposed and physically adjacent to one another; each member 2 thus in cross-section has a multi-lobed shape angled from the top down towards the inside of the craft. In the preferred embodiment shown in the aforementioned figures, each member 2 is constituted by two superimposed compartments, i.e. an upper compartment 8 with a larger cross-section, for example circular as shown, constituting a main float, and a lower compartment 9 with a smaller cross-section, constituting an auxiliary float; each member 2 thus has a bilobed cross-section.

In the remainder of the description, reference will be made more particularly to an inflatable craft the members 2 of the inflatable sponson 1 of which have a bilobed architecture, as shown in FIGS. 1, 2, 3*a* and 4 to 6, because the latter appears likely to prove the most beneficial in practice, owing to its structural simplicity and the beneficial advantages it provides, it being understood nevertheless that the provisions according to the invention that are described hereinafter can equally well be used in a craft the members 2 of the inflatable sponson 1 of which have a multilobed architecture.

Figure 3A:
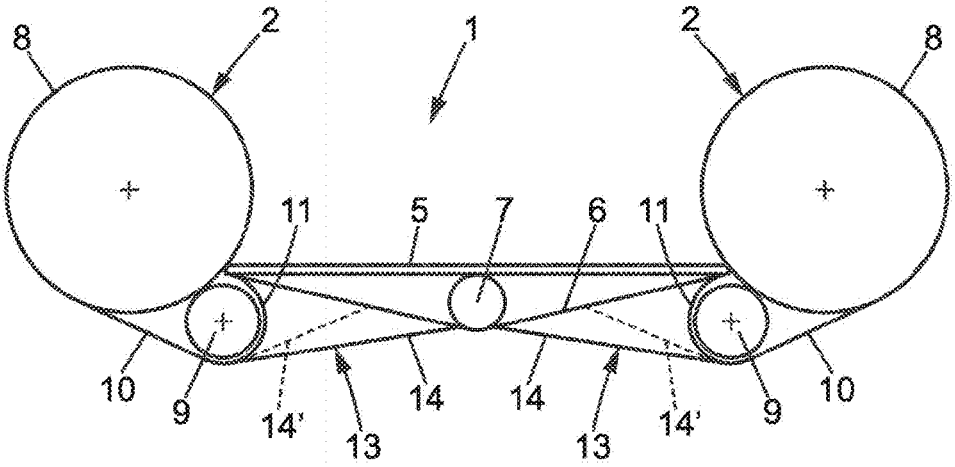
FIG. 3*a* shows very diagrammatically in cross-section and in solid lines, the embodiment of the craft according to FIGS. 1 and 2, and in dotted lines, a variant embodiment.

In each member 2, the lower compartment 9 or auxiliary float is partially surrounded by a flexible shell 11, firmly fixed to the upper compartment 8 or main float, and held within said shell 11 and when inflated, pressed against the upper compartment 8 by the tensioned shell 11, as shown in FIG. 3*a*.

The lower compartment 9 can be firmly fixed (by bonding for example) and longitudinally adjacent to the upper compartment 8 along a lower, inner circumferential area thereof (facing the other member 2) as described in FR 2 510 064, or as a variant, the lower compartment 9 can be detachable, and retained in the shell 11 and pressed against the same circumferential area of the upper compartment 8 in the inflated condition, as described in FR 2 778 626.

In both cases, each shell 11 thus forms an elongated pouch, which can be defined by a cloth or a fabric firmly fixed by the longitudinal edges thereof to an inner area of the upper compartment 8, situated at the junction or close to the junction of the bottom 5 with the upper compartment 8, on the one hand, and on the other hand, to an outer area of the upper compartment 8. Thus, the outer side portion 10 of the shell 11 that extends between the lower compartment 9 and the upper compartment 8 is tensioned and extends substantially tangentially to these compartments 8 and 9, which are dimensioned and arranged in relation to one another such that the outer side portion 10 forms a mean angle with a horizontal plane comprised between approximately 5° and 45°, the mean angle between the bottom fabric 6 and the horizontal plane being capable of being close to 15° to 20°.

The shell 11 does not necessarily need to be watertight. Advantageously, it has a closed forward end 12, preferably profiled with a bottom upturned towards the front as shown in FIGS. 1 and 4 to 6. In contrast, it has a posterior end that can be open (as shown in FIG. 2) and preferably equipped with means for retaining the auxiliary float 9, when the latter is detachable as described in FR 2 778 626.

The two right and left shells 11 have different shapes, and therefore must be manufactured separately, when they are provided with a closed forward end 12.

Each auxiliary float or lower compartment 9 has an elongated general shape (sponson- or sausage-shaped) and can be constituted either by a single piece or several end-to-end sections.

Figure 2:
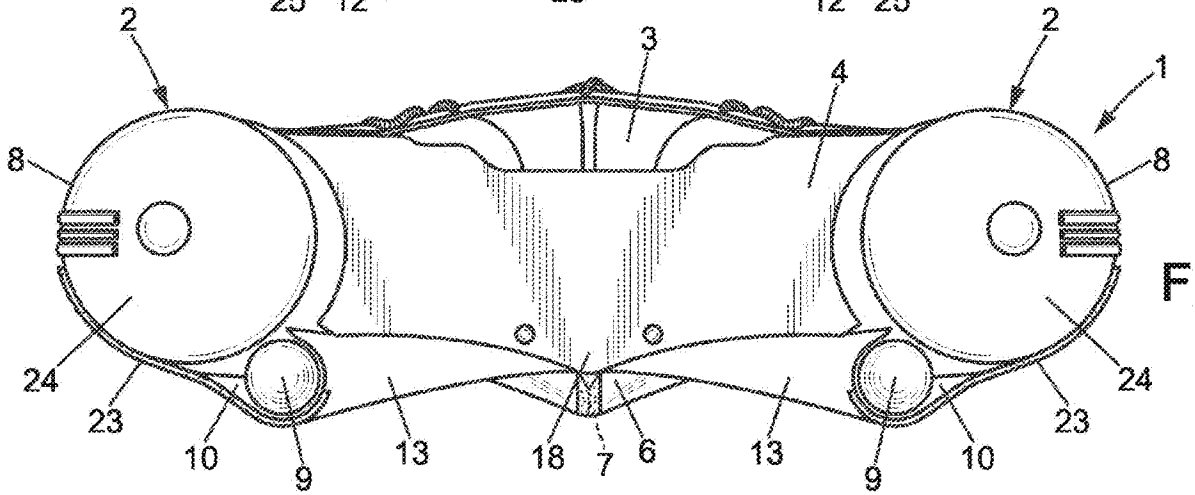
Figure 3B:
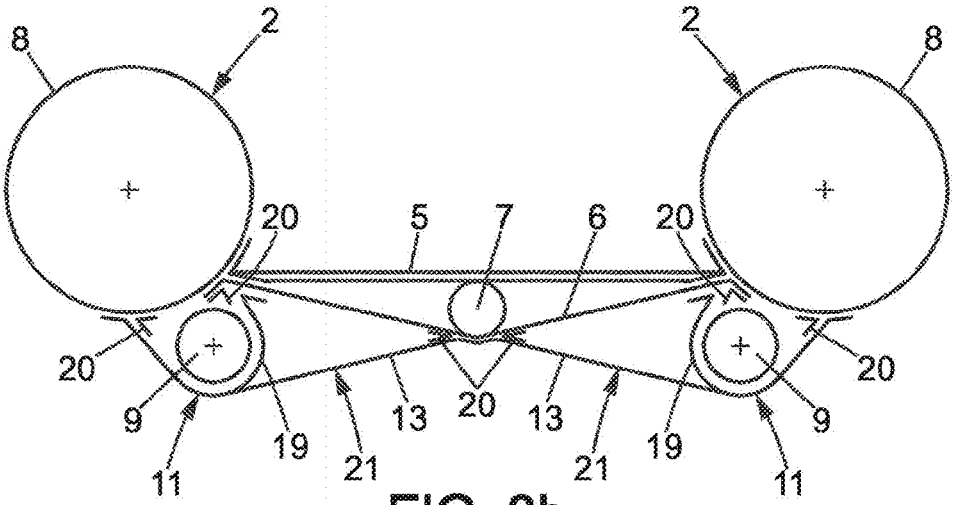
FIGS. 3*b* and 3*c* are cross-sectional views, similar to FIG. 3*a*, of two other variant embodiments.
Figure 3C:
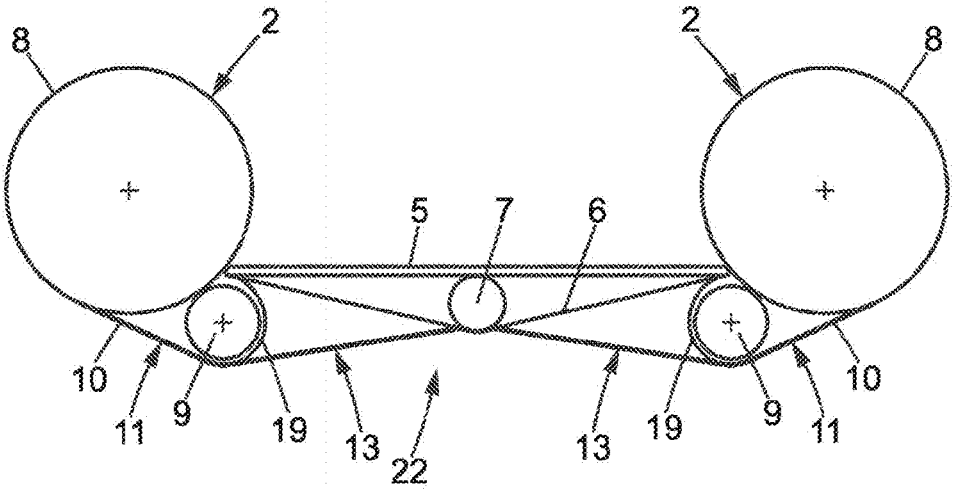

In a beneficial embodiment, described in FR 2 778 626, with reference to FIGS. 2A, 3 and 4 of said patent document, to which reference may be made for further details, the auxiliary float 9 is an elongated inflatable body, equipped with an inflation valve passing through the shell 11 via a hole therein and intended to be connected to an external inflation connection via a pipe, or connected directly to the main compartment 8 for simultaneous inflation of both inflatable enclosures. In this case, the formation of the auxiliary float 9 using several end-to-end sections requires either inflation connections between the sections in order to inflate them simultaneously, or each section to be fitted with an inflation valve. In both cases, production is more expensive than when each auxiliary float 9 is constituted by a single piece. Inserting such a float 9 in a deflated condition, therefore without rigidity, inside the shell 11 can advantageously be carried out by pulling, from the front, using a flexible cord (not shown) firmly fixed to the forward end of the float 9, and to this end, a hole must be provided in the forward end of each shell 11 in order to allow the pull cord to pass through.

Figure 1:
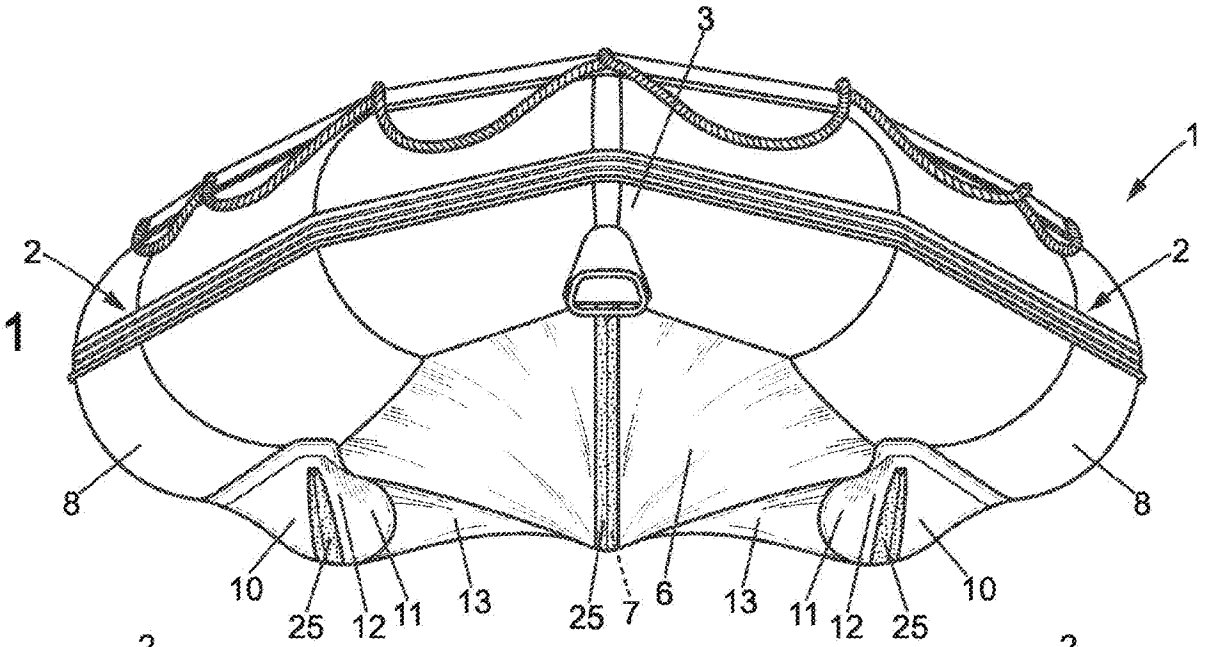
FIGS. 1 and 2 are respectively front and rear views of a practical embodiment of an inflatable craft according to the invention.

Moreover, in a preferred embodiment, the elongated inflatable body of the auxiliary float 9 is not simply cylindrical of revolution over its entire length, but has a portion that bulges vertically at the front as shown in particular in FIG. 1, then the inflatable body has a cross-section which, from the front to the rear, first increases, then decreases to become finally approximately constant (cylindrical of revolution end portion).

The complex shape thus implemented (see front view in FIG. 1) achieves an effect of wedging the auxiliary float 9 inside the shell 11, which holds it in place therein in the offset inward position that is clearly shown in the rear view in FIG. 2. This offset inward position results in the shaping of the angled fabric portion 10.

According to an essential feature specific to the invention, the craft also comprises two watertight flaps 13, made from waterproof cloth or fabric, attached in a tensioned state, substantially symmetrically with respect to the vertical mid-plane of the craft, therefore on either side of the longitudinal keel 7, each under respectively one of the two rear side portions of the V-shaped hull. As shown diagrammatically in FIG. 6, which is a bottom view of the craft, each of the two flaps 13 has a substantially trapezoid general shape, the long base of which constitutes the rear edge 14 of the flap 13, and the short base constitutes the front edge 15 of said same flap 13, while one of the sides of the trapezium constitutes the outer side edge 16 and the other the inner side edge 17 of the flap 13.

Each of the two watertight flaps 13 has its outer side edge 16 connected to the lower portion of the shell 11 that covers the lower compartment 9 situated on the same side as said flap 13, as shown in FIGS. 3*a* and 5.

Each watertight flap 13 is also connected along its inner side edge 17 to the bottom fabric 6, along a line that extends from the rear to the front of the flap 13 and of the craft, while being angled towards the lower compartment 9 of the corresponding side, since the width of the flap 13 tapers gradually from the tensioned, free rear edge 14 thereof between the ends thereof, at the transom 4, towards the front portion and the front edge 15 of the flap 13 which is or are connected in a watertight manner to the corresponding shell 11 of the lower compartment 9 on the same side, at the connection between its upper 8 and lower 9 compartments, said front edge 15 also being capable, if necessary, of being secured in a watertight manner, over at least a part of its length, against the bottom fabric 6.

In the first embodiment in FIG. 3*a*, the rear edge 14 of each flap 13 is tensioned transversally from an inner end situated substantially on the ridge of the V-shaped hull, and in the middle 18 of the base of the transom 4, as shown in FIG. 2. In this embodiment, as shown in FIG. 3*a*, the shell 11 of each lower compartment 9 surrounds the inner half of the periphery of the lower compartment 9 and is firmly fixed to the corresponding side edge of the floor 5, in the area of connection of the two compartments 8 and 9, such as to hold the lower compartment 9 in position with respect to the upper compartment 8.

Figure 6:
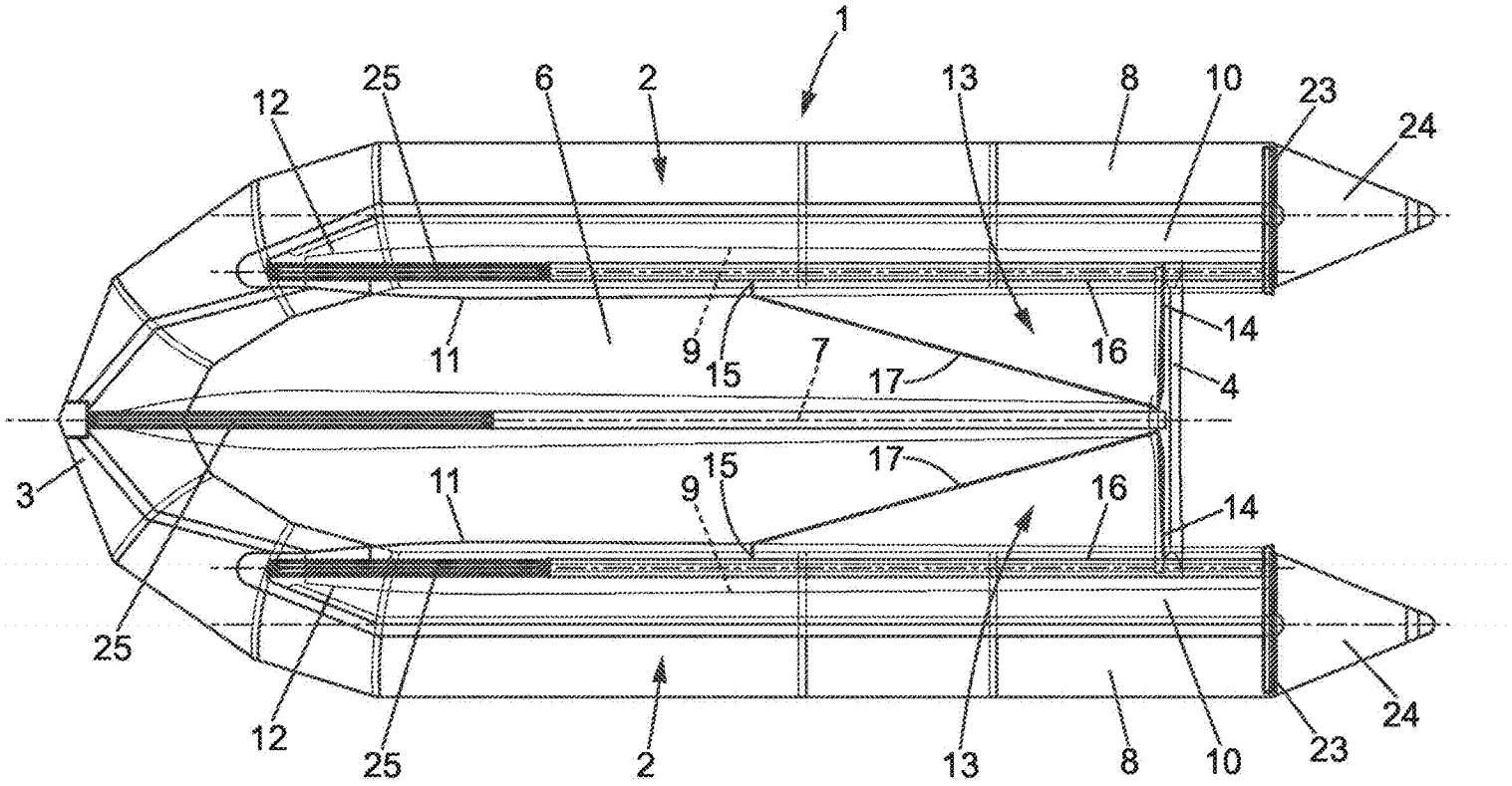
FIG. 6 is a diagrammatic bottom view of the inflatable craft in FIGS. 1, 2, 4 and 5.

In this embodiment, the two flaps 13, which are two pieces of cloth or fabric separate from one another, extend over substantially the rear two-thirds of the craft. Parallel to the longitudinal keel 7, each of the flaps 13 extends, as shown in FIG. 6, forwards from the transom 4, over a length which, depending on the model of the craft, can be comprised between approximately 55% and approximately 75% of the length of the craft.

Thus, as shown in FIGS. 1, 2, 5 and 6, each of the two flaps 13 defines with the lower compartment 9 of the corresponding side and the portion of the bottom fabric 6 also on the corresponding side, respectively one of two channels converging from the front to the rear, angled towards one another and towards the rear end of the ridge of the V-shaped hull, i.e. towards the middle 18 of the base of the transom 4, having the effect of concentrating, channelling and accelerating the flow of water with respect to the hull. In this way, these two channels allow, when the craft moves forward, and therefore when the water is channelled, due to the relative movement with respect to the craft, between the two lower compartments 9 and the shells 11 surrounding them, a flow of water which produces, on the flaps 13, lift that has the effect of raising the rear of the craft and simultaneously the tunnel effect provided by the two channels defined by the two flaps with the V-shaped hull ensures the concentration, channelling and acceleration of the flow of water with respect to the hull, said flow being guided to the area situated under the central portion of the transom 4, where the propeller of an outboard motor or engine mounted on the transom 4 is situated. The water thus reaches this area with a higher speed, which makes it possible to increase the speed of rotation of the motor or engine and of the propeller, and therefore to improve the acceleration, which is particularly advantageous in the phase of getting on the plane, during which the motor or engine usually struggles to pick up speed, more particularly if the craft is heavily laden. As a consequence, getting the craft on the plane is facilitated, even when heavily laden.

In a variant embodiment, as shown in dotted lines in FIG. 3*a*, each flap 13 can be such that its rear edge 14' has its inner end not level with the keel 7 and the middle 18 of the base of the transom 4, but level with a point of attachment to the bottom fabric 6 forming the side of the V-shaped hull of the corresponding side, this point of attachment being situated in the half of said side of the bottom fabric 6 adjacent to the keel 7. The inner side edge 17 of the flap 13 is thus still connected in a watertight manner to said side portion of the bottom fabric 6 along a line angled towards the front and towards the lower compartment 9 of the corresponding side, but at a greater distance from the keel 7, the result of which is to increase the flow section in each of the two converging channels defined by the flaps with the V-shaped hull and the two lower compartments 9, resulting in lesser acceleration of the water flow towards the motor propeller.

According to another variant, the two flaps 13 are not two individual pieces of cloth or fabric each corresponding to one of the two flaps, but the two flaps 13 together form a single piece of cloth or fabric, two portions of which each respectively constitute one of the two flaps 13, and are joined together by a connecting part that can be arranged as a strip covering the rear end portion of the V-shaped hull.

According to yet another variant, shown diagrammatically in FIG. 3*b*, each of the two flaps 13 is made from a single piece of cloth or fabric with the shell 11 partially surrounding the lower compartment 9 of the corresponding side, such that the shell 11 is, in this case, also watertight. The piece of cloth or fabric constituting a flap 13 and a shell 11 is bonded around the lower portion of the lower compartment 9, which is held in the correct position with respect to the upper compartment 8 by an additional strip of cloth or fabric, constituting a longitudinal retaining strip 19, which substantially surrounds the inner half of the periphery of the corresponding lower compartment 9 while being attached in a watertight manner, for example by bonding, to the bottom fabric 6 and/or to the upper compartment 8 by one or more U- or V-shaped angle sections such as those labeled 20 in FIG. 3*b*. One or more similar joining angle sections can be used to connect to the upper compartment 8 the outer end of the single piece 21 constituting a flap 13 and a shell 11 on a same side. Two V-shaped angle sections 20 can also be used to improve the join, for each of them, between respectively one of the two pieces 21 each of which constitutes a flap 13 and the corresponding shell 11, simultaneously improving the join with the bottom fabric 6 and the keel 7 forming the V-shaped hull.

In the variant in FIG. 3*c*, a single piece of cloth or fabric 22 simultaneously constitutes the two flaps 13 and the two shells 11, such that also in this example, longitudinal retaining strips 19 must be used to substantially surround the inner half of the periphery of each of the two lower compartments 9. Of course, angle sections such as 20 can also be used in the variant in FIG. 3*c* for improving the joins between the different cloth or fabric pieces.

Moreover, a deflector 23, allowing water to be deflected downwards, is mounted transversally to an under-side of each of said elongate members (i.e., projecting under each of the parallel members 2, behind the rear edge 14 of the flaps 13), as shown in FIGS. 2, 4 and 6. In the example craft shown, each member 2, or more precisely each main float or upper compartment 8 ends, at its rear end, in a cone 24 with a point projecting (i.e., directed) towards the rear, and the deflector 23 is secured at the base of the cone 24, as shown in FIGS. 4 and 6. In a simple embodiment, each deflector 23 is a profile made from a plastic material such as PVC, which has a triangular cross-section. This profile is attached against the upper compartment 8 and the shell 11, and extends substantially along the lower half of the periphery of the corresponding member 2, as shown in FIG. 2. Such deflectors 23 effectively provide additional lift that raises the rear part of the craft and further facilitates getting on the plane.

Profiles 25 having a triangular cross-section and made from a plastic material similar to the deflectors 23, are advantageously bonded on the portion of the keel 7 at the bow 3 and on the raised lower portions of the auxiliary floats 9 (see FIGS. 1 and 5) in order to facilitate the passage of the craft through the waves.

It is also possible to constitute each auxiliary float 9 in the form of an elongated body made from a material that is less dense than water, in particular a synthetic material such as a synthetic closed-cell foam or a solid material such as polystyrene or others. The elongated body can be made in a single piece. However, in order to facilitate the storage and transport of the deflated and dismantled craft, it may prove more beneficial to constitute the float 9 in several sections arranged end-to-end inside the shell 11. Whether in a single piece or in several sections, the float 9 thus constituted can easily be inserted inside the shell 11 due to the rigidity, albeit slight, of the constituent material.

As a result of the arrangements that have just been disclosed, the two right and left auxiliary floats 9 are less expensive to manufacture. Both the manufacture and especially the maintenance of the craft are greatly facilitated from this standpoint.

Although the auxiliary float 9 is wedged by the shell 11 against the main float 8, it is preferable to equip the rear end of the shell 11 (and also the forward end if this is not closed) with retaining means, as shown in FIG. 5 of FR 2 778 626, when said float 9 is detachable. These means, which constitute a simple safety device, can be produced simply and cheaply, for example in the form of two or three tabs extending radially from the edge of the shell 11, the free ends of which overlap one another towards the centre of the auxiliary float 9; a ring firmly fixed to a bottom tab, engaged through holes in two other superimposed tabs and a locking pin engaged in the projecting part of said ring constitute simple, effective and inexpensive fastening means.

The architecture of the auxiliary compartment 9 that has just been described is the architecture that appears likely to reliably confer the best results and advantages. However, at least for certain applications it is possible, as shown in FIG. 6 of FR 2 778 626, to give the auxiliary float 9, at least in a longitudinal portion (front portion for example) a cross-section having a complex generally curved triangular shape, closely hugging the outer contour of the main compartment 8 and the inner contour of the shell 11, so that it occupies the entire volume comprised between the shell 11 and the wall of the main compartment 8, also in such a way that it cannot slip around the compartment 8. In this specific case, an inflatable pneumatic float can be envisaged, but would be difficult and expensive to manufacture, and it seems preferable to use a solid float made from buoyant material.

The invention claimed is:

1. An inflatable craft, comprising:

at least one inflatable sponson forming two opposing elongate members, comprised of substantially parallel rearward portions and frontward portions that converge towards a front of the sponson to form a bow;

a transom linking the rearward portions of said elongate members, said transom configured to receive at least one motor or engine, each of said elongate members comprising, at least in the substantially parallel rearward portions thereof, plural tubular compartments that each have a substantially circular cross-section, one of said tubular compartments being an upper compartment, and another one of said tubular compartments being a lower compartment arranged longitudinally next to said upper compartment along a lower circumferential area of said upper compartment, said upper compartment having a cross-section greater than that of said lower compartment, said lower compartment held against said upper compartment by a flexible side shell that is made from cloth or fabric, said flexible side shell at least partially surrounding said lower compartment and is firmly fixed to said upper compartment, said flexible side shell being secured tangentially to said upper and lower compartments on an outer side of the elongate member; and a longitudinal keel arranged between a first structural element forming a floor of the inflatable craft and a second structural element that forms a watertight bottom of the inflatable craft, the floor being held, at least in a transverse direction, along said two elongate members, and said bottom being connected to peripheral edges of said floor, said longitudinal keel tensioning said bottom such that a hull of the inflatable craft formed by said bottom, tensioned by said longitudinal keel, is V-shaped, wherein two flaps, made from waterproof cloth or fabric, are attached in a watertight manner in a tensioned state, substantially symmetrically on either side of said longitudinal keel, each flap respectively arranged under one of two rear side portions of said V-shaped hull, each flap having an outer side edge along which said flap is connected to a lower portion of a corresponding lower compartment or a lower portion of said flexible side shell covering said corresponding lower compartment, and each flap having an inner side edge along which said flap is connected to said bottom along a line extending from a rear of the inflatable craft to a front of the inflatable craft and angled towards said lower compartment, a width of said flap tapering gradually from a tensioned, free rear edge thereof, proximate to said transom, to a front portion of said flap that is connected to at least one of said bottom, said corresponding lower compartment, and said flexible side shell covering said corresponding lower compartment, at a connection between said upper and lower compartments, each flap defining, with said corresponding lower compartment and said bottom, a channel converging from said front of the inflatable craft to said rear of the inflatable craft and angled towards a rear end of a ridge of said V-shaped hull, said channel configured to guide and accelerate a flow of water towards an area situated under a central portion of said transom and to increase lift of a rear portion of said V-shaped hull.

2. The inflatable craft according to claim 1, wherein each flap has a generally trapezoid shape, a long base and a short base of which respectively constitute said rear edge and a front edge of said flap, and sides of which constitute said outer and inner side edges.

3. The inflatable craft according to claim 1, wherein said rear edge of each flap extends transversally from an inner end situated substantially on said ridge of said V-shaped hull, in a middle of a base of said transom.

4. The inflatable craft according to claim 1, wherein said rear edge of each flap extends transversally from an inner end of a portion of said bottom constituting an adjacent side of said V-shaped hull, said inner end being situated within a half, adjacent to said ridge of said V-shaped hull.

5. The inflatable craft according to claim 1, wherein said flaps extend forwards from said transom, over a length, parallel to said longitudinal keel, extending approximately 55% and approximately 75% of a total length of the inflatable craft.

6. The inflatable craft according to claim 1, wherein said flaps extend substantially over a rear two-thirds of the inflatable craft.

7. The inflatable craft according to claim 1, wherein said flaps are two pieces of cloth or fabric, separate from one another.

8. The inflatable craft according to claim 1, wherein said flaps are each formed, respectively, of one of two portions of a single piece of cloth or fabric.

9. The inflatable craft according to claim 1, wherein each flap is made from a single piece of cloth or fabric, said flexible side shell associated with said lower compartment.

10. The inflatable craft according to claim 1, wherein a single piece of cloth or fabric constitutes both said flaps and said flexible side shells of said lower compartments.

11. The inflatable craft according to claim 1, wherein a deflector, configured to deflect water downwards, is mounted transversally to an under-side of each of said elongate members behind said rear edge of said flaps.

12. The inflatable craft according to claim 11, wherein each deflector is made from synthetic material having a triangular cross-section, and is attached to the flexible side shell and the upper compartment of the elongate member, substantially along a lower half of a periphery of said elongate member.

13. The inflatable craft according to claim 11, wherein a rearward end of each elongate member is formed as a dome or cone projecting towards said rear of the inflatable craft, and said deflector is secured substantially at a base of said dome or cone.

14. The inflatable craft according to claim 1, wherein said longitudinal keel is a pneumatic keel constituted by at least one elongated inflatable enclosure.

15. The inflatable craft according to claim 1, wherein said floor is held pressed against a lower and inner face of said upper compartments of said elongate members, and said bottom is secured to said elongate members, at connections between said upper and lower compartments.

16. The inflatable craft according to claim 1, wherein said upper and lower compartments of each elongate member of said sponson comprise two inflatable compartments, and respectively constitute a main float and an auxiliary float.

17. The inflatable craft according to claim 16, wherein each auxiliary float comprises at least one inflatable elongated body having a cross-section which gradually increases, then decreases, in a direction from the front of the inflatable craft to the rear of the inflatable craft.

18. The inflatable craft according to claim 1, wherein each flexible side shell has a closed, profiled forward end with an upwardly-angled lower portion.

* * * * *